US007783047B2

(12) United States Patent
Miura et al.

(10) Patent No.: US 7,783,047 B2
(45) Date of Patent: Aug. 24, 2010

(54) SOUND FILED REPRODUCTION APPARATUS AND SOUND FILED SPACE REPRODUCTION SYSTEM

(75) Inventors: Masayoshi Miura, Chiba (JP); Susumu Yabe, Tokyo (JP)

(73) Assignee: Sony Corporation (JP)

( * ) Notice: Subject to any disclaimer, the term of this patent is extended or adjusted under 35 U.S.C. 154(b) by 1365 days.

(21) Appl. No.: 10/987,851

(22) Filed: Nov. 12, 2004

(65) Prior Publication Data

US 2005/0117753 A1 Jun. 2, 2005

(30) Foreign Application Priority Data

Dec. 2, 2003 (JP) ..... P2003-403592

(51) Int. Cl.
*H04R 5/00* (2006.01)

(52) U.S. Cl. ..... 381/17; 381/61

(58) Field of Classification Search ..... 381/17–23, 381/98, 103, 1, 61, 63, 26, 300, 332, 310, 381/309; 84/630, 601, 602; 700/94
See application file for complete search history.

(56) References Cited

U.S. PATENT DOCUMENTS

| | | | | |
|---|---|---|---|---|
| 4,856,064 | A * | 8/1989 | Iwamatsu | 381/1 |
| 5,245,130 | A * | 9/1993 | Wheaton | 84/742 |
| 5,999,630 | A * | 12/1999 | Iwamatsu | 381/17 |
| 6,401,028 | B1 * | 6/2002 | Kamiya et al. | 701/200 |
| 6,584,202 | B1 | 6/2003 | Montag et al. | |
| 2003/0007648 | A1 * | 1/2003 | Currell | 381/61 |

FOREIGN PATENT DOCUMENTS

| | | | |
|---|---|---|---|
| JP | 03-254298 | A | 11/1991 |
| JP | 04-132499 | A | 5/1992 |
| JP | 06-020448 | A | 1/1994 |
| JP | 06-315200 | A | 11/1994 |
| JP | 07-184298 | A | 7/1995 |
| JP | (07-312800) | * | 11/1995 |
| JP | 07-312800 | A | 11/1995 |
| JP | 09-146446 | A | 6/1997 |

(Continued)

OTHER PUBLICATIONS

A Discussion on Wave Front Synthesis Using Multi-Channel Speaker Reproduction, Collected Papers on Reports at Acoustical Society of Japan, Sep., 2000, pp. 407-408, Takeda et al.

(Continued)

*Primary Examiner*—Vivian Chin
*Assistant Examiner*—Lun-See Lao
(74) *Attorney, Agent, or Firm*—Lerner, David, Littenberg, Krumholz & Mentlik, LLP

(57) ABSTRACT

A sound field reproduction apparatus generates sound field synthesizing parameters according to a relative positional relationship between the listener and the sound source and performs frequency conversion on sound data according to the relative positional relationship. A convolutional operation is conducted on the sound data that are subjected to the frequency conversion and the generated sound field synthesizing parameters in order to synthesize the sound of the sound source of each channel. The synthesized sound is subjected to wave front synthesis for the synthesized sound by using n-channel sound sources to reproduce a sound field in a predetermined area.

8 Claims, 13 Drawing Sheets

FOREIGN PATENT DOCUMENTS

| | | | |
|---|---|---|---|
| JP | 09-160549 | A | 6/1997 |
| JP | 09-305099 | A | 11/1997 |
| JP | 10-326072 | A | 12/1998 |
| JP | 2000-013900 | A | 1/2000 |
| JP | 2001-517005 | A | 10/2001 |
| JP | 2001-340644 | A | 12/2001 |
| JP | 2002-131072 | A | 5/2002 |

OTHER PUBLICATIONS

Office Action from corresponding Chinese Application 200410100622.8, dated Nov. 14, 2008.

* cited by examiner

SOUND FILED REPRODUCTION APPARATUS AND SOUND FILED SPACE REPRODUCTION SYSTEM

BACKGROUND OF THE INVENTION

1. Field of the Invention

This invention relates to a sound field reproduction apparatus and a sound field space reproduction system that provide a virtual reality space with an effect of reality sensation.

This application claims priority of Japanese Patent Application No. 2003403592, filed on Dec. 2, 2003, the entirety of which is incorporated by reference herein.

2. Related Background Art

Speakers are or a stereo headphone is used to reproduce a three-dimensional sound field. When speakers are used, the sound field is reproduced in a listening area that spreads to a certain extent. Since the sound field is synthetically reproduced, the listener in the sound field can perceive exactly what is supposed to be perceived in the sound field. When, on the other hand, a stereo headphone is used, the sound that is supposed to be reproduced to the ears of a listener who is in the sound field is reproduced to the ears of the listener by controlling the waveform that is reproduced and conveyed to the ears of the listener.

With conventional reproduction of three-dimensional sound field, the listener places him- or herself at a predetermined virtual listening position, which is a fixed position, in a space of virtual reality so as to listen to reproduced sounds coming from a fixed or moving virtual sound source. With this technique, however, the listener can listen only to the sounds that get to the specified listening position and its vicinity in a virtual reality space. In other words, it is not possible to reproduce a sound field space in such a way that the listener can freely move in a virtual space.

To cope with this problem, patent Document 1 (Japanese Patent Application Laid-Open Publication No. 7-312800) proposes a technique of producing a sound image that matches the position, the direction, the moving speed and the moving direction of the listener and those of each of the sound sources in a sound field space that is produced by processing direct sounds, initial reflected sounds and reverberated sounds, taking the characteristics of the sound field space into consideration, on an assumption that the listener uses a stereo headphone.

However, the technique described in patent Document 1 (Jpn. Pat. Appln. Laid-Open Publication No. 7-312800) only makes it possible to reproduce a space to the sense of hearing. In other words, the listener cannot perceive a sensation of freely moving in a virtual reality space or that of free fall.

Additionally, when a sound field is reproduced by way of a stereo headphone, the listener cannot share the produced sound field space with other listeners. In other words, the listener cannot enjoy conversations with other listeners on the reproduced sound field. For example, it is not possible to provide such a space to the passengers in a moving vehicle or in a dining car.

As for reproducing a space, a listener can acquire an acoustic perception of moving in a space when actual sound sources are arranged in a listening room and the listener moves in the room. However, it is then necessary to prepare a full-size sound field space and such an arrangement is unrealistic.

SUMMARY OF THE INVENTION

In view of the above-identified problems, it is therefore the object of the present invention to provide a sound field reproduction apparatus and a sound field space reproduction system that can synthetically produce a desired sound field in a listening area and with which a listener in the listening area can perceive sounds in a virtual space.

In an aspect of the present invention, the above object is achieved by providing a sound field reproduction apparatus adapted to reproduce a sound field in a virtual space within a predetermined area of a real space from contents data including information on the position of the sound source in a virtual space and sound data in response to information on the position of the listener indicating the position of the listener in the virtual space, the apparatus comprising: a sound field synthesizing parameter generating means for generating sound field synthesizing parameters in response to the relative positional relationship between the position of the listener and the position of the sound source on the basis of information on the position of the listener and information on the position of the sound source; a frequency conversion means for performing an operation of frequency conversion on sound data as a function of the relative positional relationship according to the information on the information on the position of the listener and the information on the position of the sound source; a sound field synthesizing means for performing a convolutional operation on the sound data subjected to frequency conversion and the generated sound field synthesizing parameters and synthesizing sound data for each of n channels; and a sound field reproducing means for performing an operation of wave front synthesis, using the synthesized sound data for each channel and reproducing a sound field in a predetermined area.

In another aspect of the present invention, there is provided a sound field space reproduction system comprising: a sound field reproduction apparatus adapted to reproduce a sound field in a virtual space within a predetermined area of a real space from contents data including information on the position of the sound source in a virtual space and sound data in response to information on the position of the listener indicating the position of the listener in the virtual space; and a reverberating apparatus for reverberating the environment in a virtual space in a real space; the sound field reproduction apparatus having: a sound field synthesizing parameter generating means for generating sound field synthesizing parameters in response to the relative positional relationship between the position of the listener and the position of the sound source on the basis of information on the position of the listener and information on the position of the sound source; a frequency conversion means for performing an operation of frequency conversion on sound data as a function of the relative positional relationship according to the information on the information on the position of the listener and the information on the position of the sound source; a sound field synthesizing means for performing a convolutional operation on the sound data subjected to frequency conversion and the generated sound field synthesizing parameters and synthesizing sound data for each of n channels; and a sound field reproducing means for performing an operation of wave front synthesis, using the synthesized sound data for each channel and reproducing a sound field in a predetermined area.

Thus, with a sound field reproduction apparatus and a sound field space reproduction system according to the invention, the sound field that is synthetically produced in a listening area in a real space is controlled in response to the relative positional relationship between the position of the listener and the position of the sound source on the basis of information on the position of the listener and information on the position of the sound source. Therefore, the listener perceives a sound image that responds to the movement, if any, of the listener and, if the listener is not moving, he or she can feel a sensation that he or she, whichever appropriate, is moving.

Additionally, since a sound field space is reproduced in a predetermined area, all the listeners staying in that area can share a same sound field space.

Still additionally, the listener can have a natural perception of moving when the acceleration of an object and the air flow are changed relative to the listener in response to the change in the sound image relative to the listener according to positional information on the listener.

DETAILED DESCRIPTION OF THE PREFERRED EMBODIMENTS

Now, a sound field reproduction apparatus according to the invention will be described in terms of an optical disc replay unit for reproducing a sound field space by using an array speaker with which the listener can perceive a desired sound image. Note that information on the position of sound source (to be referred to as sound source position information hereinafter) and information on the position of the listener (to be referred to as listener position information) in the following description respectively indicates the position of the sound source and the position of the listener in a virtual space.

Figure 1:
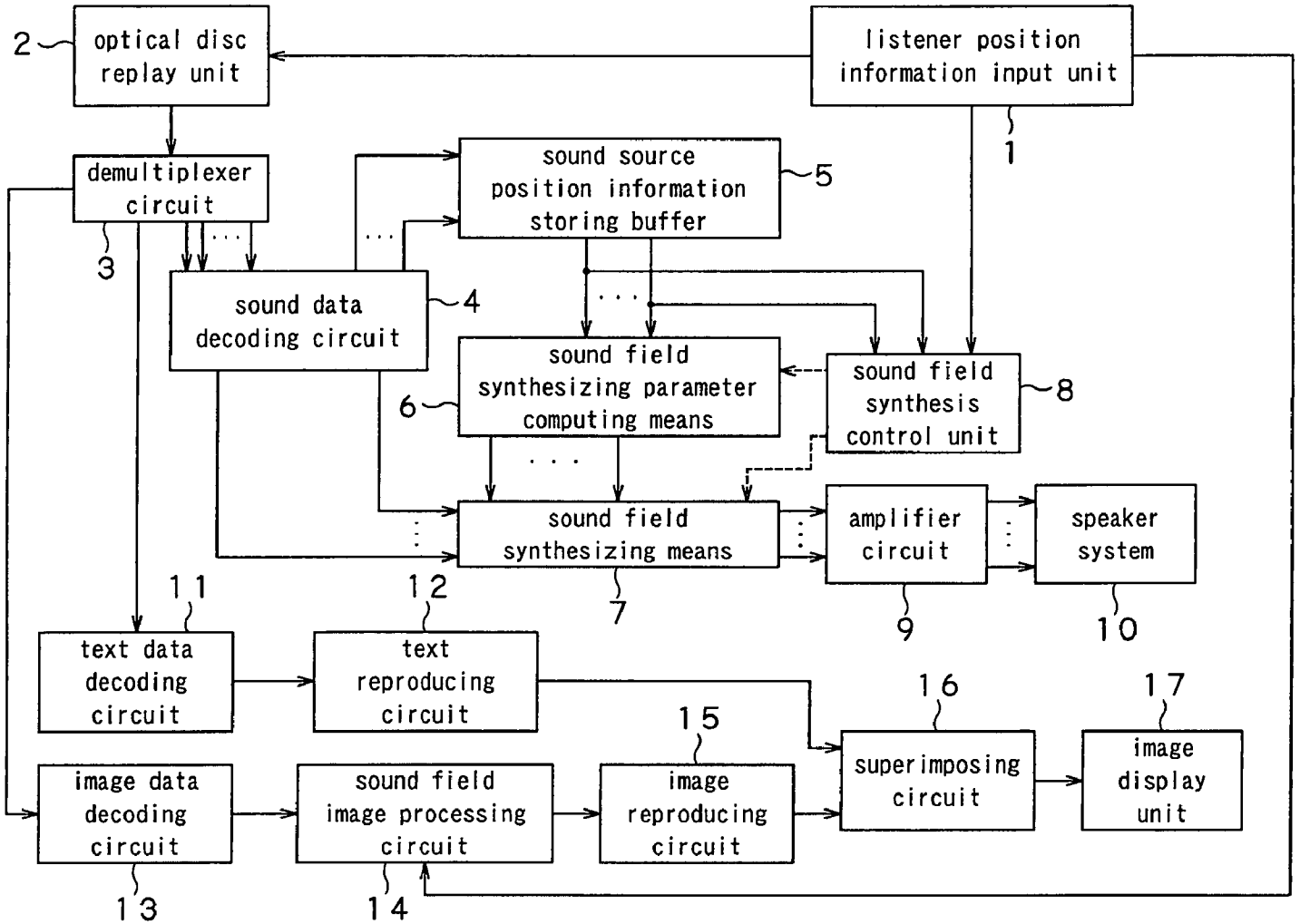
FIG. 1 is a schematic block diagram of the first embodiment of sound field reproduction apparatus according to the invention, illustrating its configuration.
Figures 2A, 2B, 2C:
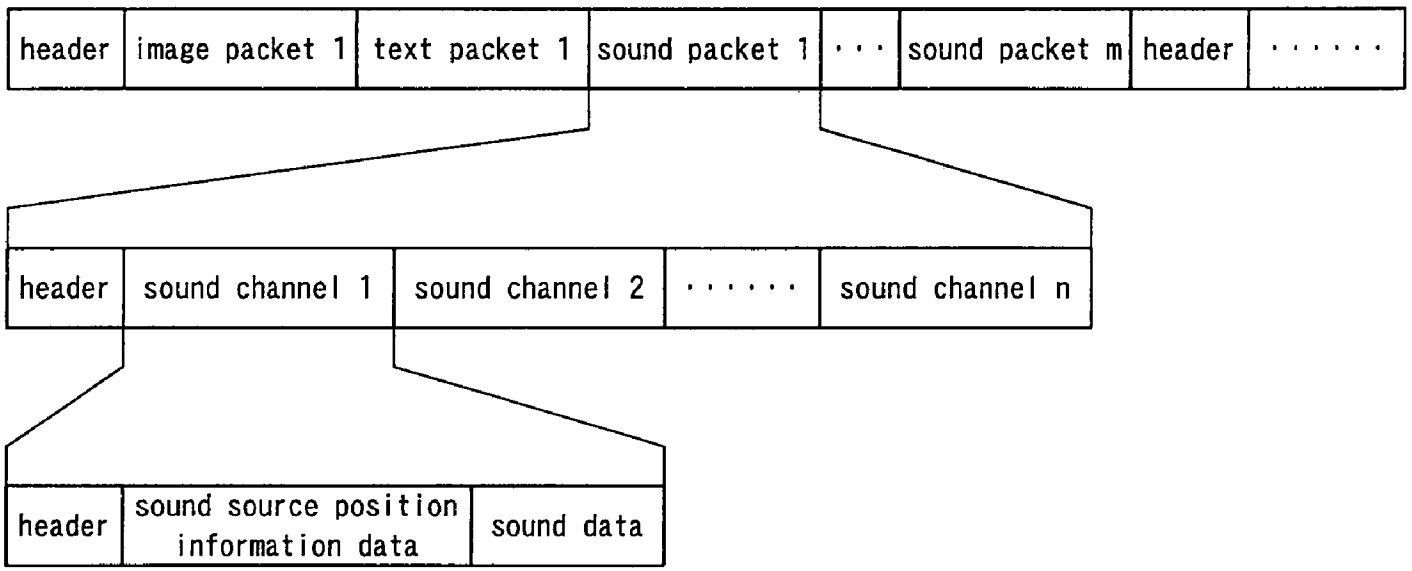
FIG. 2 is a schematic illustration of the data recorded on an optical disc that can be used in the first embodiment.

FIG. 1 is a schematic block diagram of the first embodiment of sound field reproduction apparatus according to the invention, illustrating its configuration. Referring to FIG. 1, image data, text data and sound data that are in a packet format are multiplexed and recorded on an optical disc to be used as a recording medium with the sound field reproduction apparatus in a manner as shown in FIG. 2A. Channels as many as the number of sound sources of the array speaker are allocated to each sound packet as shown in FIG. 2B. Sound data on a virtual sound source and information on the position of the virtual sound source is assigned to each sound channel as shown in FIG. 2C. Note that, for the purpose of the present invention, sound data may be used to express not only human voices but also chirping of birds, purring of vehicle engines, music, sound effects and any other sounds.

The sound field reproduction apparatus of the first embodiment as shown in FIG. 1 comprises a listener position information input unit 1 for inputting the position of the listener in a virtual space, an optical disc replay unit 2 for replaying an optical disc on the basis of the listener position information that is input, a demultiplexer circuit 3 for demultiplexing the reproduced data, a sound data decoding circuit 4 for decoding the sound data of each sound channel of the packet selected on the basis of the listener position information and the sound source position information, a sound source position information storing buffer 5 for storing the decoded sound source position information, a sound field synthesizing parameter computing means 6 for computationally determining the sound field synthesizing parameters for controlling the channels according to the listener position information and the sound source position information, a sound field synthesizing means 7 for synthesizing a sound field on the basis of the sound field synthesizing parameters and the sound data of the sound channels, a sound field synthesis control unit 8 for controlling the sound field synthesizing parameter computing means and the sound field synthesizing means on the basis of the listener position information, an amplifier circuit 9 for amplifying the sound signals of the sound channels for which a sound field is synthesized, a speaker system 10 for reverberating a sound field space by using the sound sources of n channels, a text data decoding circuit 11 for decoding the text data separated by the demultiplexer circuit 3, a text reproducing circuit 12 for reproducing the decoded text data, an image data decoding circuit 13 for decoding the image data separated by the demultiplexer circuit 3, a sound field image processing circuit 14 for processing the decoded image data on the basis of the listener position information, an image reproducing circuit 15 for reproducing the image data that have been processed for sound field and image, a superimposing circuit 16 for superimposing the text on the image, and an image display unit 17 for displaying the reproduced image.

Figure 3:
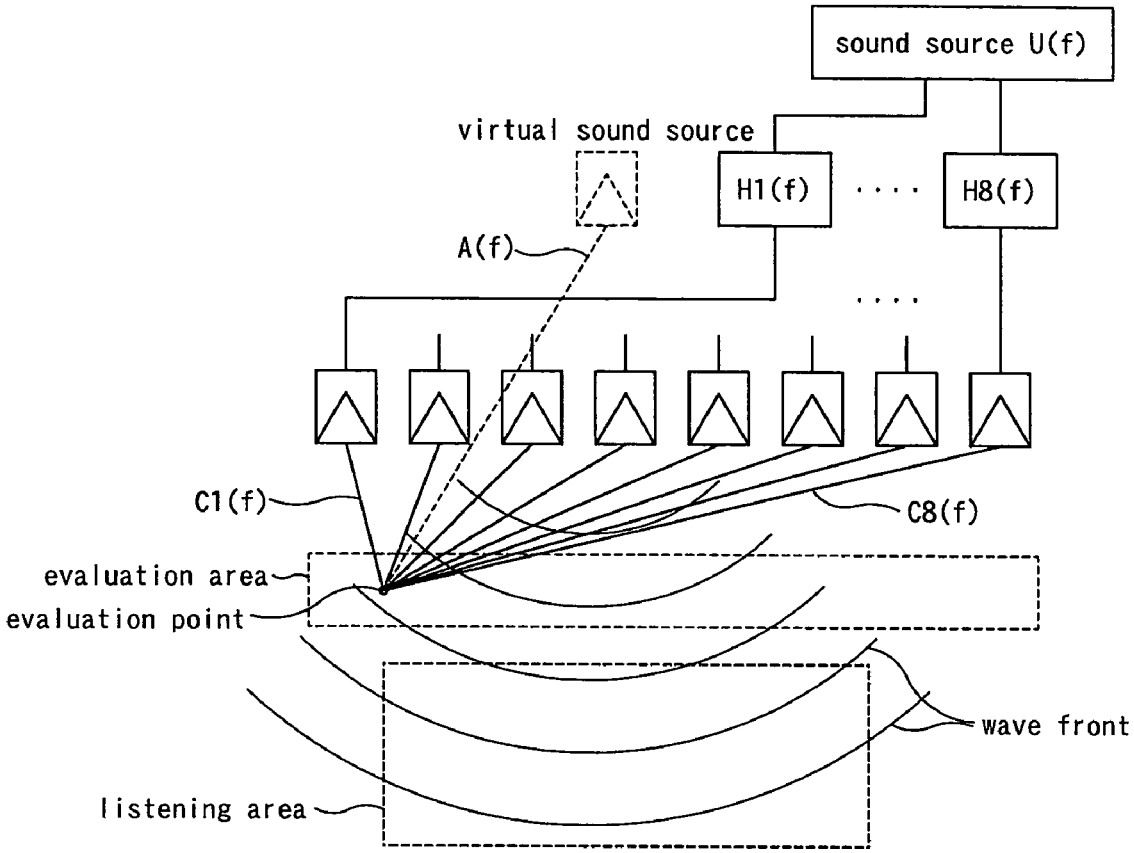
FIG. 3 is a schematic illustration of an array speaker that can be applied to the present invention.

According to the present invention, a sound field space that can be shared by a plurality of people is provided by using an array speaker for the speaker system 10 to reverberate a desired sound field in a listening area. The sound field reverberating system using such an array speaker is a sound field synthesizing system adapted to control the sound waves emitted from the array speaker so as to reverberate a sound field in a listening area that is identical with the sound field produced by the sound waves emitted from the sound sources in the real space (see, inter alia, Takeda et al., "A Discussion on Wave Front Synthesis Using Multi-Channel Speaker Reproduction", Collected Papers on Reports at Acoustical Society of Japan, September 2000, pp. 407-408). More specifically, as shown in FIG. 3, an array speaker is controlled so as to minimize the error that is the difference between the sound field produced by a virtual sound source and the sound field produced by the array speaker at each and every evaluation point in the evaluation area defined near the front line of the array speaker and the sound field in the evaluation area is reverberated in such a way that it sounds as if it were emitted from a virtual sound source position. In other words, the transfer functions H1($f$), . . . , H8($f$) of the filters inserted in series to the respective speakers are controlled in such a way that the error energy that is the difference between the transfer function A(f) from the virtual sound source position to the evaluation point and the total sum of the transfer functions H1(*f*)C1(*f*), . . . , H8(*f*)C8(*f*) from each of the speakers of the array speaker that is a drive point to the evaluation point. At this time, the transfer functions C1(*f*), . . . , C8(*f*) from each drive point (speaker) to the evaluation point are computed as distance attenuation characteristics, assuming the drive point as point sound source. Thus, the wave fronts of the sound waves emitted from the array speaker are synthesized as sound waves emitted from the sound source positions so that, the sound field in the listening area is reverberated by the sound waves passing through the evaluation area in such a way that it sounds as if it were emitted from a virtual sound source position.

Figure 4A:
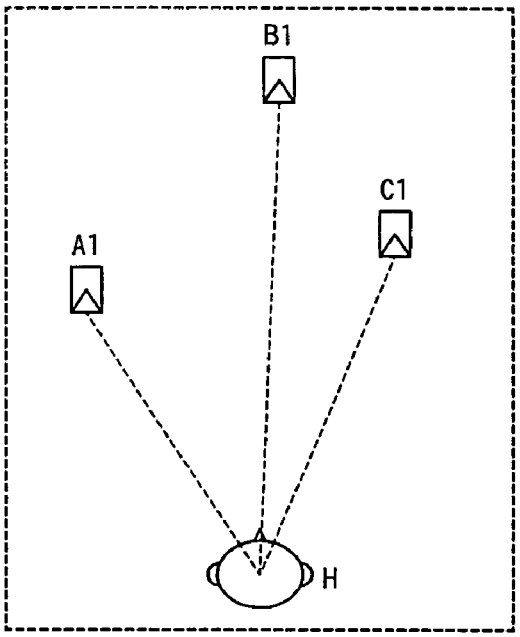
FIGS. 4A through 4D are schematic illustrations of sound field synthesis realized by applying the present invention.
Figure 4B:
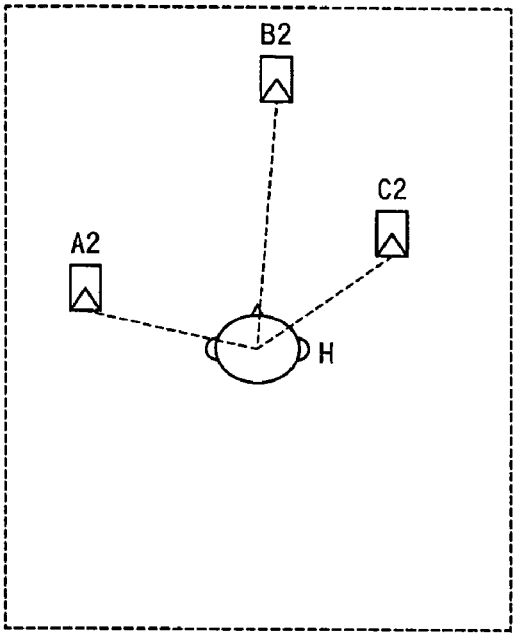
Figure 4C:
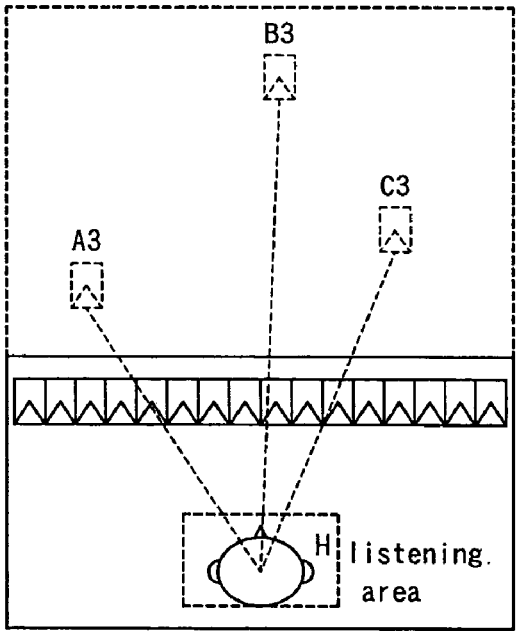
Figure 4D:
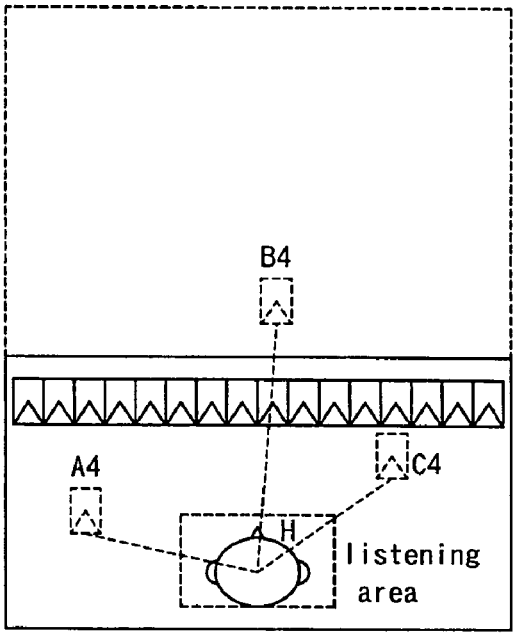

When, for example, reverberating a sound field where the listener H moves through sound sources A1, B1, C1 in a real sound field as shown in FIG. 4A, the characteristics of the sound field synthesizing means 7 that controls the array speaker are not influenced by the movement of the listening position of the listener in the actual listening room but only by the movement of the virtual sound source (e.g., A3->A4) as shown in FIGS. 4C and 4D.

Now, synthesis of a sound field by using an array speaker will be described by referring to FIGS. 1 and 5. The sound field synthesizing parameter computing means 6 computationally determines the digital filter coefficients (H1(*f*), . . . , Hn(f)) for controlling the channels of the speakers of the array speaker according to the sound source position information. If it is detected that the listening position is moving according to the listening position information from the listener position information input unit 1, the sound field synthesizing parameter computing means 6 computationally determines the digital filter coefficients that corresponds to the relative positional relationship between the listening position and the sound source position.

Figure 5:
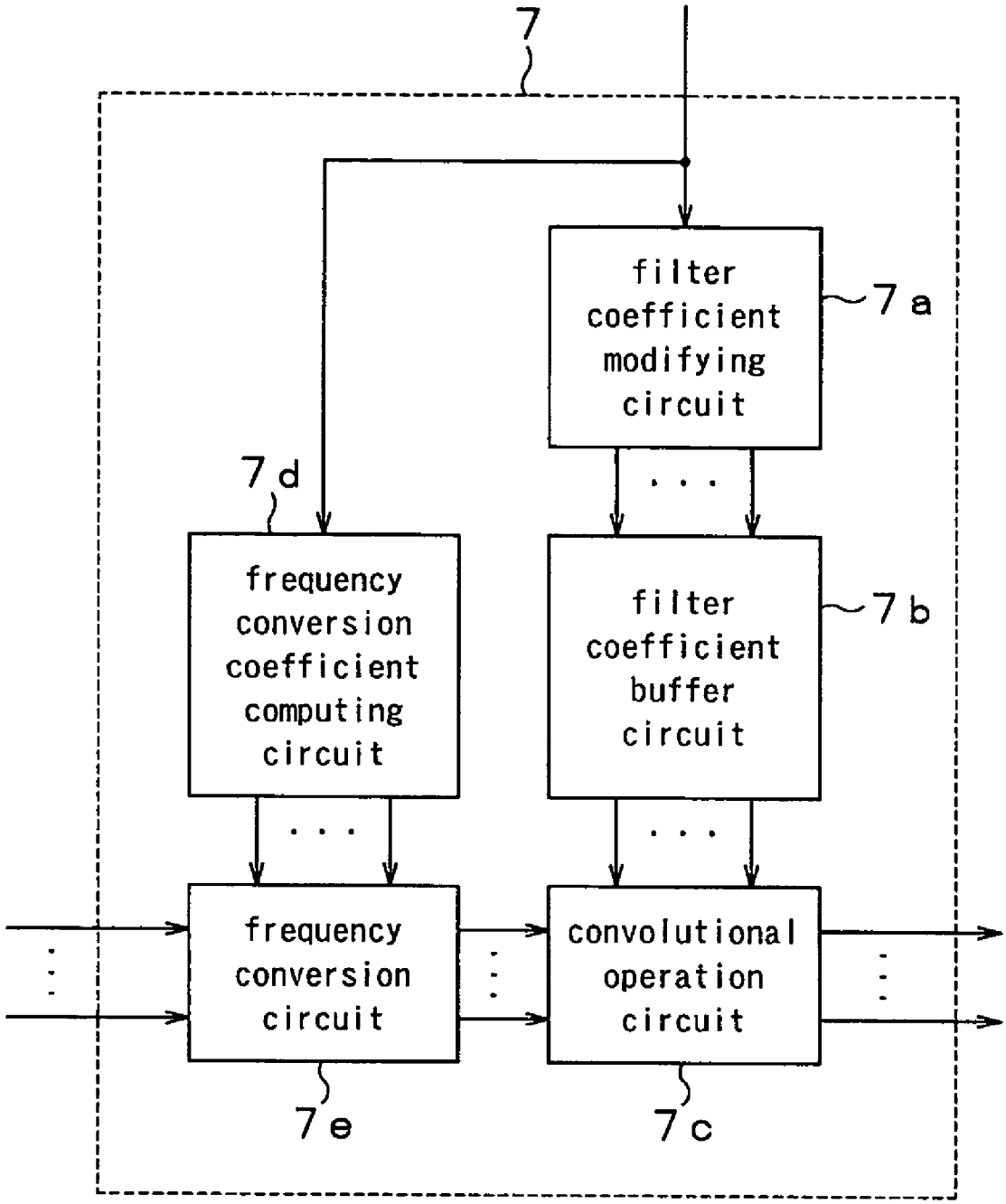
FIG. 5 is a schematic block diagram of a sound field synthesizing means that can be used for the purpose of the present invention.

As shown in FIG. 5, the sound field synthesizing means 7 has a filter coefficient modifying circuit 7*a*, a filter coefficient buffer circuit 7*b*, a convolutional operation circuit 7*c*, a frequency conversion coefficient computing circuit 7*d* and a frequency conversion circuit 7*e*. The filter coefficient modifying circuit 7*a* modifies the digital filter coefficient computationally determined by the sound field synthesizing parameter computing means as a function of the change in the relative positional relationship between the listening position and the sound source position and sends the modified digital filter coefficient to the convolutional operation circuit 7*c* by way of the filter coefficient buffer circuit 7*b*. Since a Doppler effect arises due to the relative moving speed of the sound source and the listener, the frequency conversion coefficient computing circuit 7*d* computationally determines the frequency conversion coefficient of the sound data of the sound source from the sound source position information and the listener position information and carries out an operation of frequency conversion by means of the frequency conversion circuit 7*e*. The convolutional operation circuit 7*c* performs a convolutional operation on the modified filter coefficient and the sound data obtained as a result of the frequency conversion and outputs an acoustic signal. Since the range of the frequency change due to the Doppler effect is determined as a function of the relative relationship between the speed of the wave propagated through the medium and the moving speed of the sound source or the listening point, the frequency conversion coefficient of the virtual sound source is computed from the sound source moving speed in the sound source position information and the listening point moving speed. While there are various techniques for frequency conversion, the method disclosed in Japanese Patent Application Laid-Open Publication No. 6-20448 may suitably be used for the purpose of the present invention.

In this way, the sound field synthesizing means 7 has a functional feature of performing not only a filtering operation on the sound data, using the sound field synthesizing filter coefficient, but also an operation of frequency conversion of the sound data in order to correspond to the Doppler effect due to the movement of the sound source or that of the listening position and reverberates the sound field in the listener area, using the array speaker. Therefore, listener in the listening area can have a perception of listening to sounds while moving in a large space, although he or she is in a limited acoustic space for the reproduced sounds. While the convolutional operation circuit 7*c* is formed in FIG. 5 on an assumption of using a finite-extent impulse response (FIR) filter, it may alternatively be formed on an assumption of using an infinite impulse response (IIR) filter.

Figure 6:
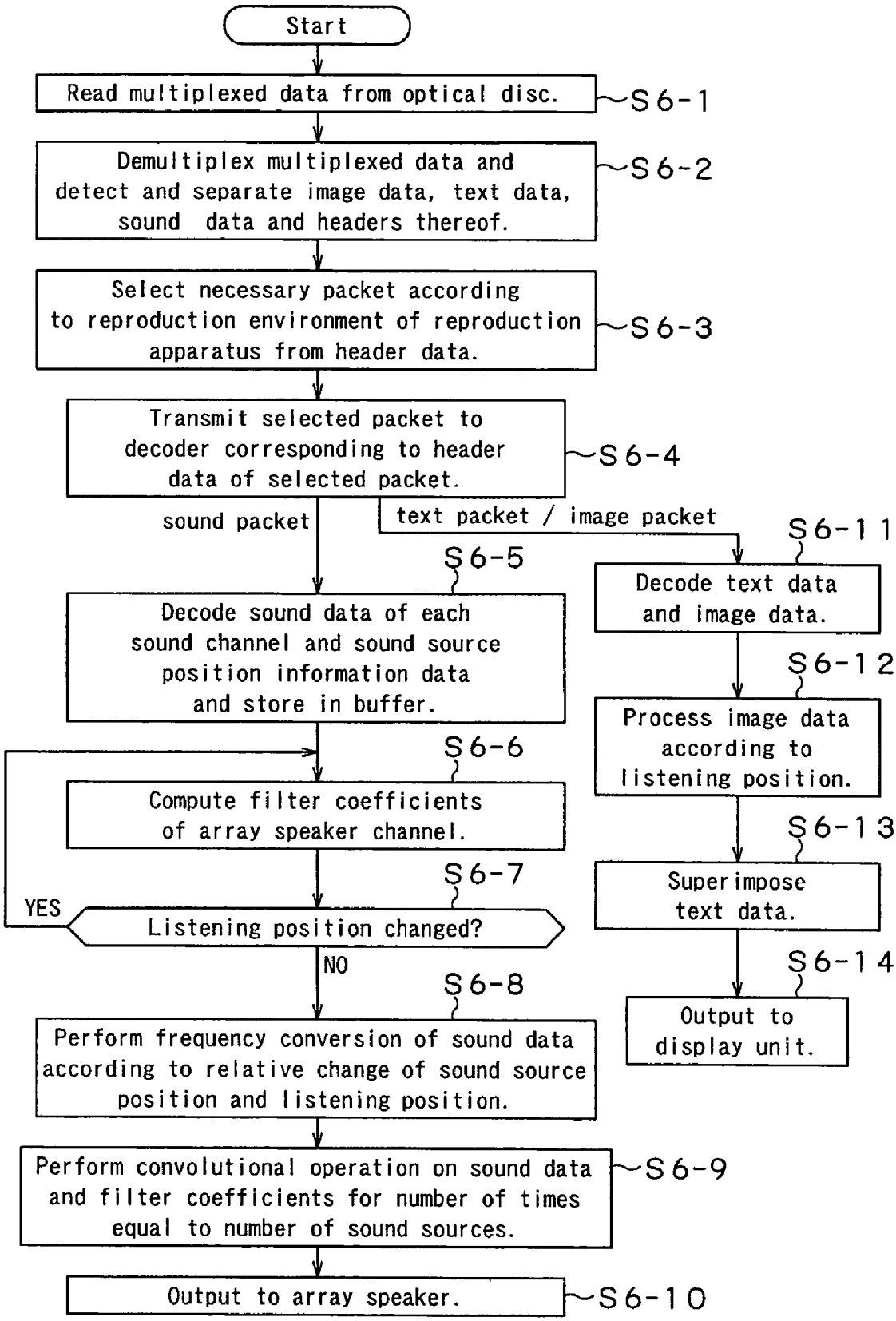
FIG. 6 is a former half of a flow chart of the operation of the first embodiment of sound field reproduction apparatus.

Now, the operation of the sound field reproduction apparatus of the first embodiment will be described below by referring to FIG. 6. The optical disc replay unit 2 reads out multiplexed data as shown in FIG. 2 from the optical disc on the basis of the listener position information input to the listener position information input unit 1 (Step S6-1). Then, the demultiplexer circuit 3 demultiplexes the read out data and detects image data, text data, sound data and headers for them so as to separate them from each other (Step S6-2). Then, it selects the necessary packet depending on the reproduction environment of the optical disc replay unit 2 from the header data (Step S6-3) and transmits the data of the selected packet to the decoder that corresponds to the header of the selected packet (Step S6-4). The reproduction environment is based on the listener position information and hence may vary as a function of the input listener position information from the listener position information input unit 1.

The sound data and the sound source position information data transmitted to the sound data decoding circuit 4 in Step S6-4 are decoded and stored in the buffer (Step S6-5). The sound source position information that indicates the sound source position of each sound channel, the moving speed and the moving direction of the sound source is stored in the sound source position information storing buffer 5.

The sound field synthesizing parameter computing means 6 computationally determines the coefficients (H1(*f*), . . . , Hn(f)) of the digital filters for controlling the respective channels of the array speaker according to the sound source position information from the sound source position information storing buffer 5 (Step S6-6).

If it is detected in Step S6-7 that the listener position is moving according to the listener position information from the listener position information input unit 1, the sound field synthesis control unit 8 transmits the modifying information to the sound field synthesizing parameter computing means 6 and the sound field synthesizing means 7 so as to have them computationally determine the digital filter coefficients once again from the relative position of the sound source that varies as a function of the listener position and the sound source position (Step S6-6). If it is not detected that the listener position is moving, the sound field synthesizing means 7 computationally determines the frequency conversion coefficient of the sound data from the sound source position information and the listener position information and performs an operation of frequency conversion at the frequency conversion circuit 7*e* (Step S6-8).

The sound field synthesizing means 7 repeats the convolutional operation on the modified filter coefficient as computed in Step S6-6 and the sound data obtained as a result of the frequency conversion in Step S6-8 for a number of times equal to the number of sound sources (Step S6-9). The sound data that are used for the convolutional operation are output to the array speaker (Step S6-10).

The text data and the image data transmitted from the demultiplexer circuit 3 in Step S6-4 are decoded respectively by the text data decoding circuit 11 and the image data decoding circuit 13 according to the coding method and the frame rate contained in the header data (Step S6-11). Then, the decoded image data is processed by the sound field image processing circuit 14 according to the listener position information (Step S6-12). For example, the image data will be processed so as to move the scenic image in response to the movement of the listener. The decoded text signal, on the other hand, is superimposed on the image signal according to the timing information contained in the header data (Step S6-13) and output to the display unit in the image signal format that matches the display unit (Step S6-14).

In this way, the listener can feel as if he or she is moving even if not moving at all as a result of computationally determining the digital filter coefficients.

A filter coefficient bank that stores filter coefficients computationally determined in advance for certain sound source positions may be used in place of the sound field synthesizing parameter computing means 6 that computationally determines the digital filter coefficients. The filter coefficient bank selects a filter coefficient that matches the sound source position. If the sound source is found at an intermediary position and the filter coefficient bank does not store any matching filter coefficient, it computationally determines the filter coefficient by interpolation.

The operation of the sound field reproduction apparatus comprising the filter coefficient bank in place of the sound field synthesizing parameter computing means 6 will be described below by referring to FIG. 7.

The optical disc replay unit 2 reads out multiplexed data as shown in FIG. 2 from the optical disc on the basis of the listener position information input to the listener position information input unit 1 (Step S7-1). Then, the demultiplexer circuit 3 demultiplexes the read out data and detects image data, text data, sound data and headers for them so as to separate them from each other (Step S7-2). Then, it selects the necessary packet depending on the reproduction environment of the optical disc replay unit 2 from the header data (Step S7-3) and transmits the data of the selected packet to the decoder that corresponds to the header of the selected packet (Step S7-4). The reproduction environment is based on the listener position information and hence may vary as a function of the input listener position information from the listener position information input unit 1.

The sound data and the sound source position information data transmitted to the sound data decoding circuit 4 in Step S7-4 are decoded and stored in the buffer (Step S7-5). The sound source position information that indicates the sound source position of each sound channel, the moving speed and the moving direction of the sound source is stored in the sound source position information storing buffer 5.

The filter coefficient bank selects the coefficients (H1(*f*), . . . , Hn(f)) of the digital filters for controlling the respective channels of the array speaker according to the sound source position information from the sound source position information storing buffer 5 (Step S7-6). At this time, it is determined if the filter coefficient to be selected is found in the filter coefficient bank or not (Step S7-6). If it is determined that the filter coefficient to be selected is not found and hence the sound source is found at an intermediary position of two positions for which the filter coefficient bank stores coefficient parameters, it computes interpolating data (Step S7-8). On the other hand, if it is determined that the filter coefficient to be selected is found in the filter coefficient bank, the processing operation proceeds to Step S7-9.

If it is detected in Step S7-9 that the listener position is moving according to the listener position information from the listener position information input unit 1, the sound field synthesis control unit 8 transmits the modifying information to the filter coefficient bank and the sound field synthesizing means 7 so as to have them select the digital filter coefficients once again from the relative position of the sound source that varies as a function of the listener position and the sound source position (Step S7-6). If it is not detected that the listener position is moving, the sound field synthesizing means 7 computationally determines the frequency conversion coefficient of the sound data from the sound source position information and the listener position information and performs an operation of frequency conversion at the frequency conversion circuit 7*e* (Step S7-10).

The sound field synthesizing means 7 repeats the convolutional operation on the filter coefficient as selected in Step S7-7 or the filter coefficient as determined by interpolation in Step S7-8 and the sound data obtained as a result of the frequency conversion in Step S7-10 for a number of times equal to the number of sound sources (Step S7-11). The sound data that are used for the convolutional operation are output to the array speaker (Step S7-12).

The text data and the image data transmitted from the demultiplexer circuit 3 in Step S7-4 are decoded respectively by the text data decoding circuit 11 and the image data decoding circuit 13 according to the coding method and the frame rate contained in the header data (Step S7-13). Then, the decoded image data is processed by the sound field image processing circuit 14 according to the listener position information (Step S7-14). For example, the image data will be processed so as to move the scenic image in response to the movement of the listener. The decoded text signal, on the other hand, is superimposed on the image signal according to the timing information contained in the header data (Step S7-15) and output to the display unit in the image signal format that matches the display unit (Step S7-16).

In this way, by configuring the sound field reproduction apparatus so as to comprise a filter coefficient bank in place of a sound field synthesizing parameter computing means 6 for computationally determining the digital filter coefficients for controlling the channels of the array speaker, it is possible to eliminate the computationally determining the filter coefficients and simplify the system.

Figure 8:
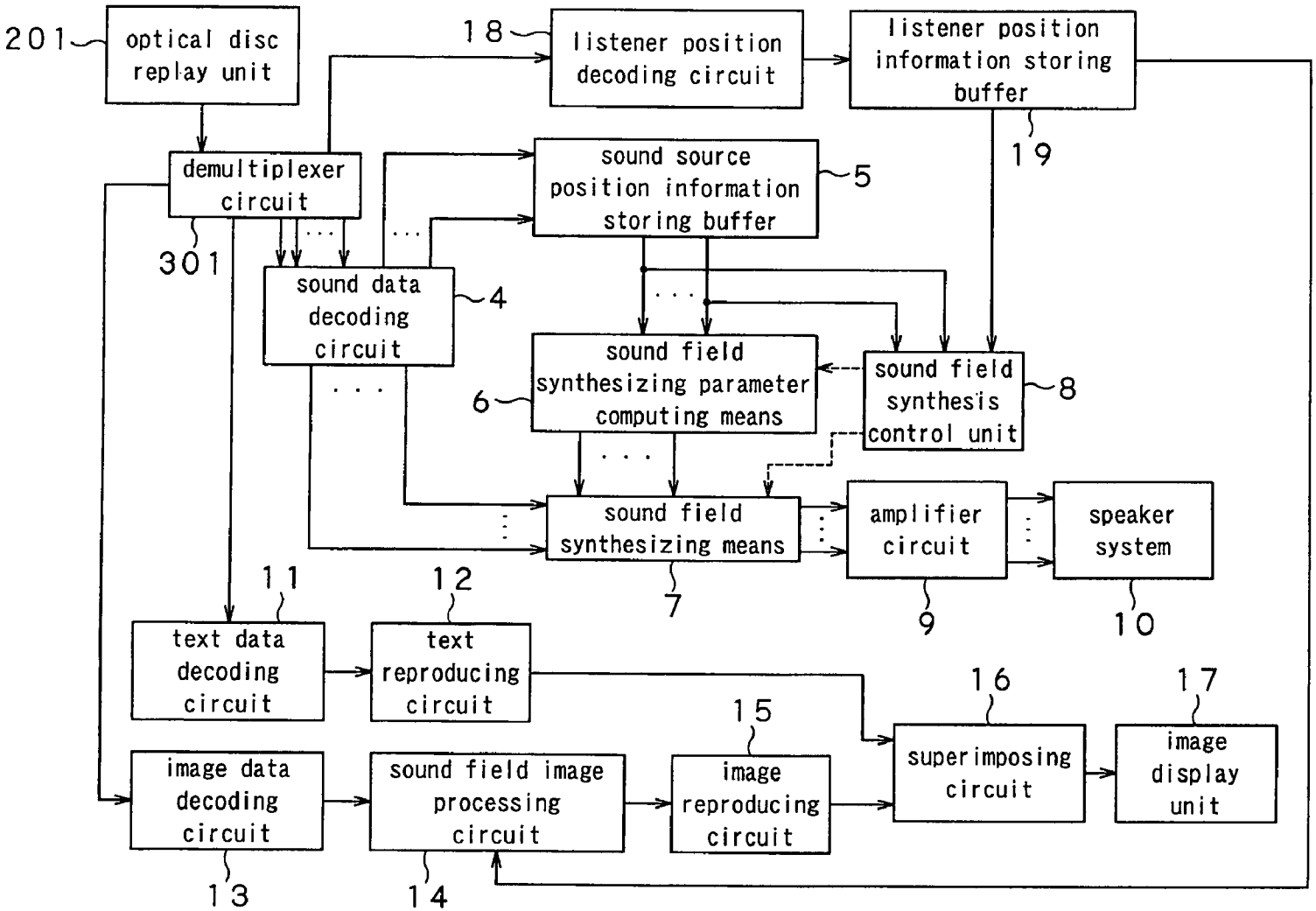
FIG. 8 is a schematic block diagram of the second embodiment of sound field reproduction apparatus according to the invention, illustrating its configuration.

FIG. 8 is a schematic block diagram of the second embodiment of sound field reproduction apparatus according to the invention, illustrating its configuration. Optical discs to be used with the second embodiment are adapted to store listener position information that is multiplexed with other information. The optical disc stores listener position information for the listener position that may change as the operation of replaying the optical disc progresses.

The sound field reproduction apparatus of the second embodiment reads listener position information from the optical disc storing the listener position information and reproduces a sound field space according to the listener position information.

More specifically, the sound field reproduction apparatus of this embodiment comprises an optical disc replay unit 201 for replaying an optical disc, a demultiplexer circuit 301 for demultiplexing the read out data, a listener position decoding circuit 18 for decoding the listener position information, a listener position information storing buffer 19 for storing the decoded listener position information, a sound data decoding circuit 4 for decoding the sound data of each sound channel of the sound packet and the sound source position information, a sound source position information storing buffer 5 for storing the decoded sound source position information, a sound field synthesizing parameter computing means 6 for computationally determining the sound field synthesizing parameters for controlling the channels according to the listener position information and the sound source position information, a sound field synthesizing means 7 for synthesizing a sound field on the basis of the sound field synthesizing parameters and the sound data of the channels, a sound field synthesis control unit 8 for controlling the sound field synthesizing parameter computing means and the sound field synthesizing means on the basis of the listener position information, an amplifier circuit 9 for amplifying the sound signals of the sound channels for which a sound field is synthesized, a speaker system 10 for reverberating a sound field space by using the sound sources of n channels, a text data decoding circuit 11 for decoding the text data separated by the demultiplexer circuit 301, a text reproducing circuit 12 for reproducing the decoded text data, an image data decoding circuit 13 for decoding the image data separated by the demultiplexer circuit 301, a sound field image processing circuit 14 for processing the decoded image data on the basis of the listener position information, an image reproducing circuit 15 for reproducing the image data that have been processed for sound field and image, a superimposing circuit 16 for superimposing the text on the image and an image display unit 17 for displaying the reproduced image.

Figure 9:
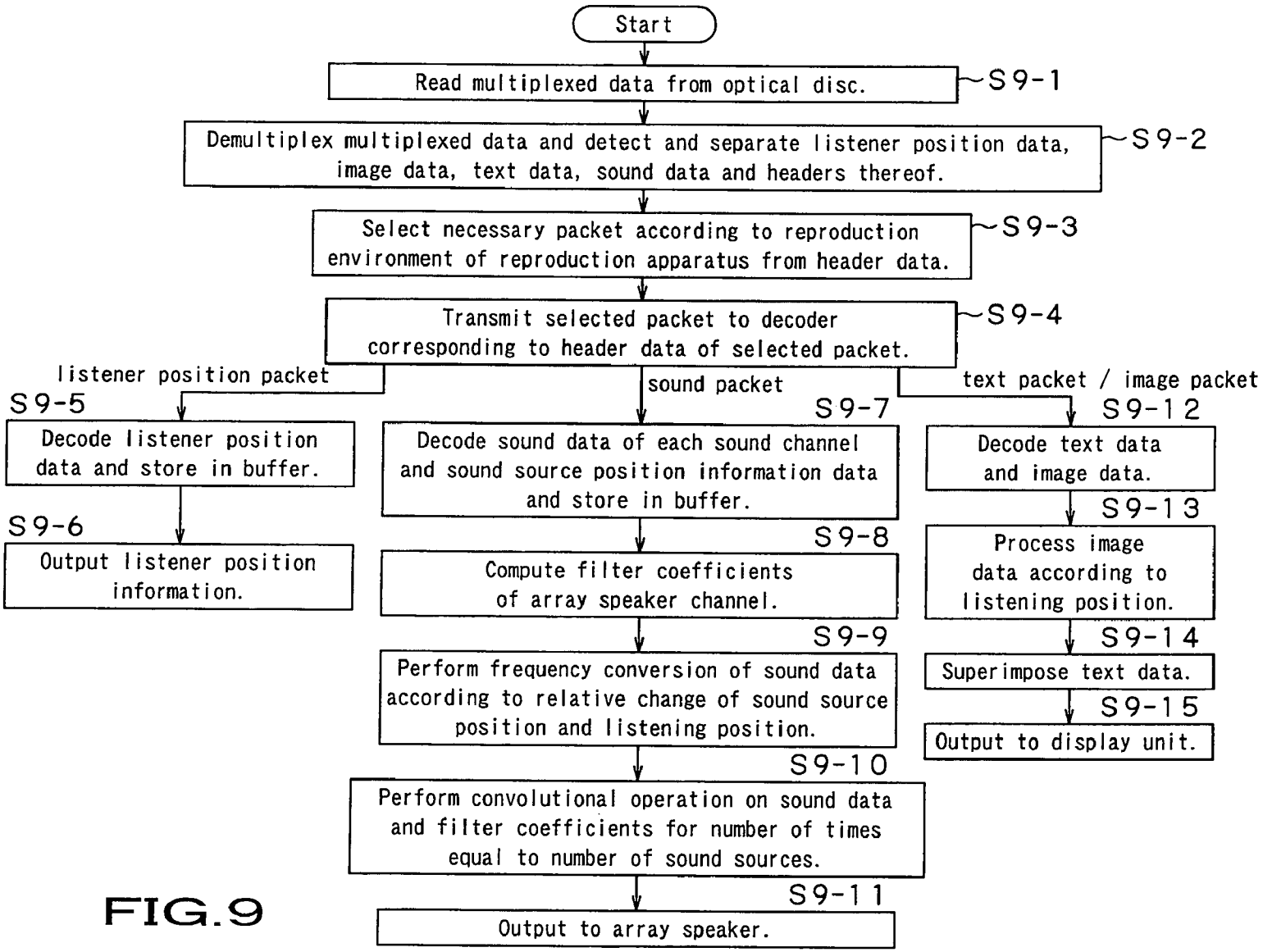
FIG. 9 is a flow chart of the operation of the second embodiment of sound field reproduction apparatus.

Now, the operation of the sound field reproduction apparatus of the second embodiment will be described below by referring to FIG. 9. The optical disc replay unit 201 reads out multiplexed data from the optical disc (Step S9-1). Then, the demultiplexer circuit 301 demultiplexes the read out data and detects image data, text data, sound data and headers for them so as to separate them from each other (Step S9-2). Then, it selects the necessary packet depending on the reproduction environment of the optical disc replay unit 2 from the header data (Step S9-3) and transmits the data of the selected packet to the decoder that corresponds to the header of the selected packet (Step S9-4). The listener can select a reproduction environment from the scenes prepared for reproduction and stored on the optical disc in advance.

The listener position information transmitted to the listener position data decoding circuit 18 in Step S9-4 are decoded (Step S9-5) and output to the sound field synthesis control unit 8 and the sound field image processing circuit 14 according to the reproduction environment (Step S9-6).

The sound data and the sound source position information data transmitted to the sound data decoding circuit 4 in Step S9-4 are decoded and stored in the buffer (Step S9-7). The sound source position information that indicates the sound source position of each sound channel, the moving speed and the moving direction of the sound source is stored in the sound source position information storing buffer 5.

The sound field synthesizing parameter computing means 6 computationally determines the coefficients (H1(*f*), . . . , Hn(f)) of the digital filters for controlling the respective channels of the array speaker according to the sound source position information from the sound source position information storing buffer 5 (Step S9-8).

The frequency conversion coefficient of the sound data of the sound source is computationally determined from the sound source position information and listener position information, and then the frequency conversion circuit 7*e* carries out an operation of frequency conversion (Step S9-9).

The sound field synthesizing means 7 repeats the convolutional operation on the modified filter coefficient as computed in Step S9-8 and the sound data obtained as a result of the frequency conversion in Step S9-9 for a number of times equal to the number of sound sources (Step S9-10). The sound data that are used for the convolutional operation are output to the array speaker (Step S9-11).

The text data and the image data transmitted from the demultiplexer circuit 301 in Step S9-4 are decoded respectively by the text data decoding circuit 11 and the image data decoding circuit 13 according to the coding method and the frame rate contained in the header data (Step S9-12). Then, the decoded image data is processed by the sound field image processing circuit 14 according to the listener position information (Step S9-13). For example, the image data will be processed so as to move the scenic image in response to the movement of the listener. The decoded text signal, on the other hand, is superimposed on the image signal according to the timing information contained in the header data (Step S9-14) and output to the display unit in the image signal format that matches the display unit (Step S9-15).

Figure 7:
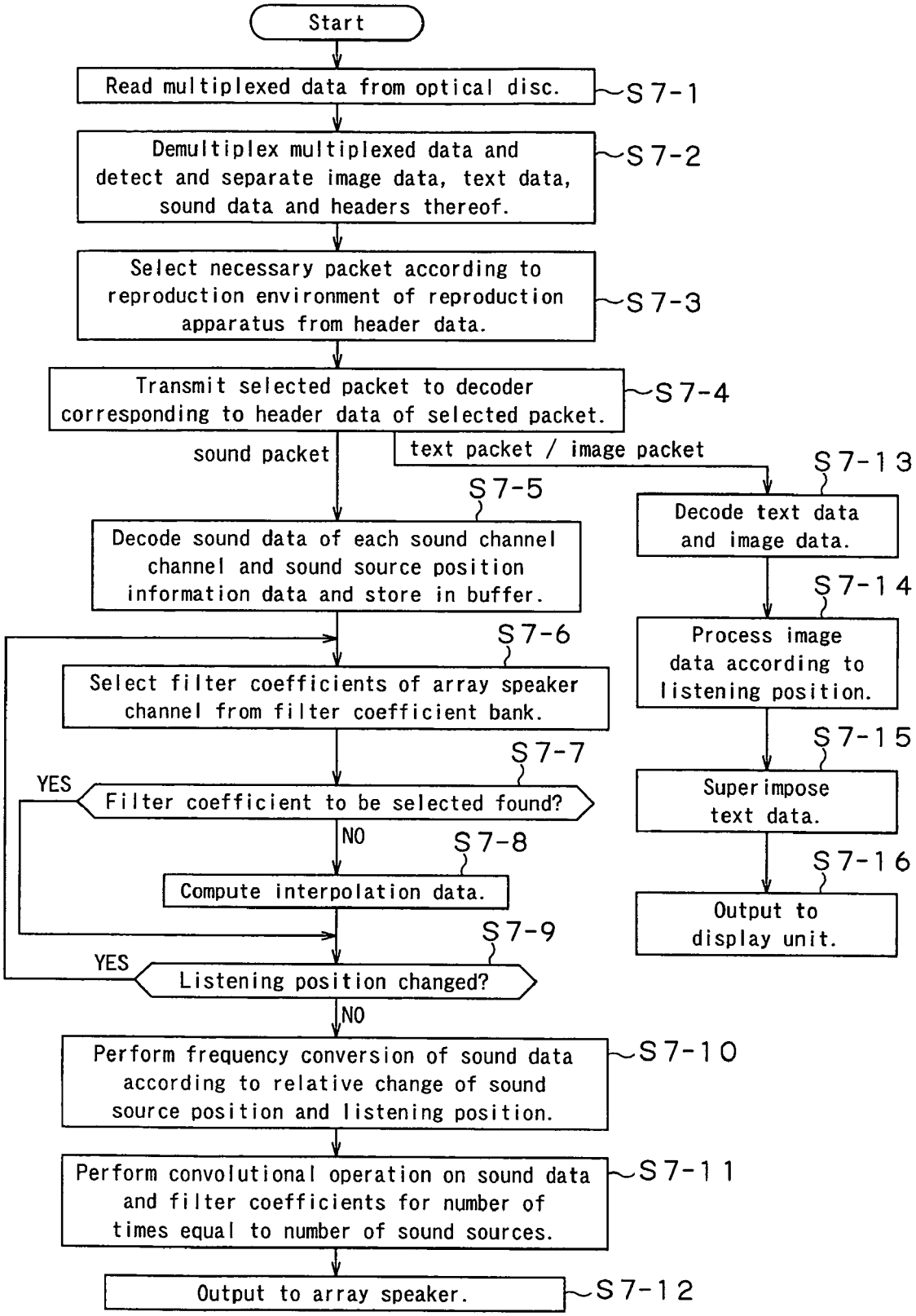
FIG. 7 is a latter half of a flow chart of the operation of the first embodiment of sound field reproduction apparatus.

A filter coefficient bank may be used in place of the sound field synthesizing parameter computing means 6 that computationally determines the digital filter coefficients as shown in FIG. 7.

In this way, with the second embodiment of sound field reproduction apparatus, it is possible to reproduce contents data that do not change the positional relationship between the sound sources in the vehicle and the listener if the vehicle moves but changes the positional relationship between the sound sources outside the vehicle and the listener so that the listener can feel as if he or she is moving in an automobile or a train.

Figure 10:
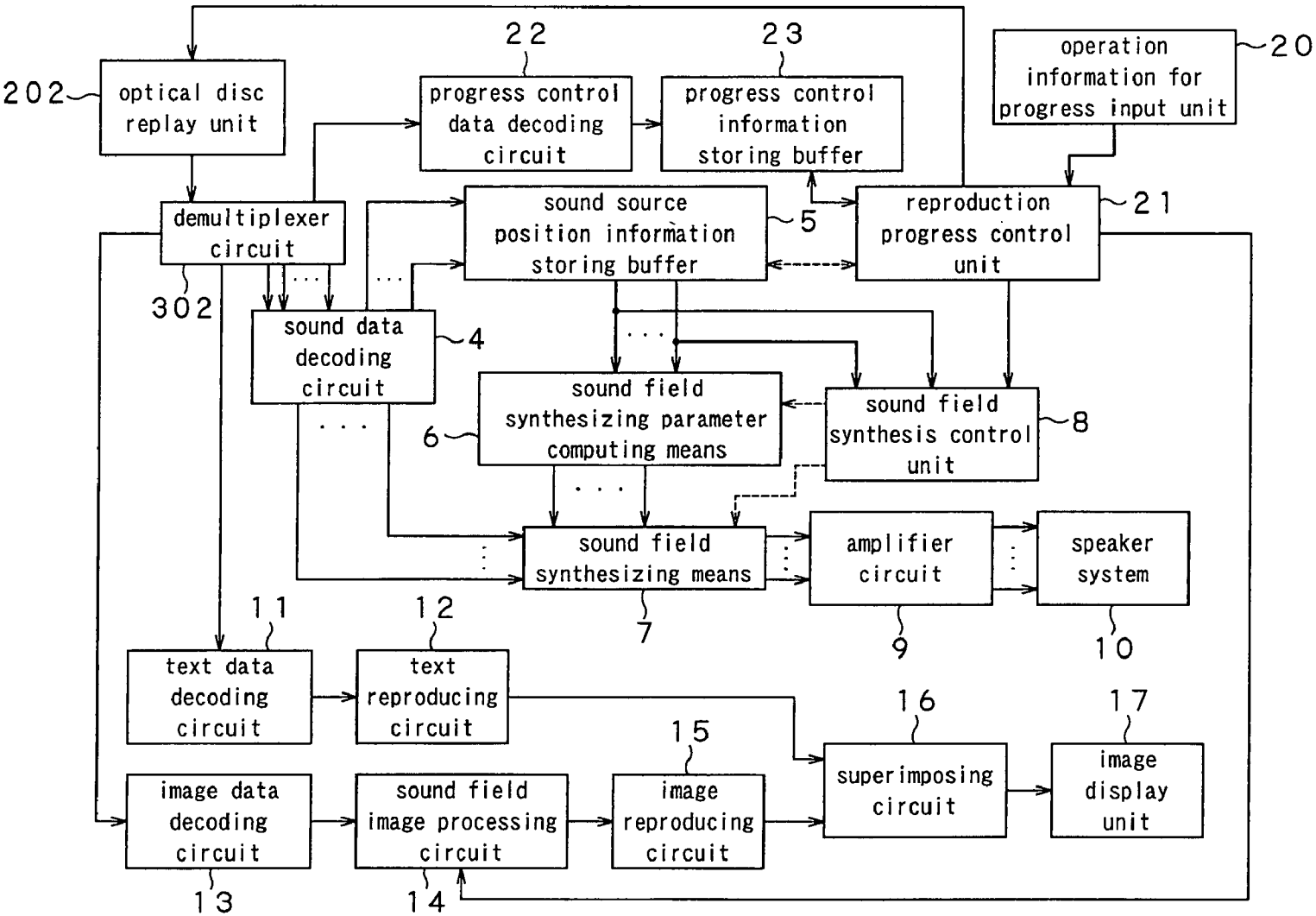
FIG. 10 is a schematic block diagram of the third embodiment of sound field reproduction apparatus according to the invention, illustrating its configuration.

FIG. 10 is a schematic block diagram of the third embodiment of sound field reproduction apparatus according to the invention, illustrating its configuration. With the third embodiment, the operator of the apparatus operates for the progress of data reproduction and a reproduction progress control unit controls the operation of replaying the optical disc according to the operation for the progress of data reproduction and the current data reproducing situation. The optical disc stores progress control information with which the operator of the apparatus operates for the progress of data reproduction and the listener position may change appropriately depending on the operation for the progress of data reproduction.

Thus, with the third embodiment of sound field reproduction apparatus, the listener position information is determined as a function of the operation for the progress of data reproduction. For example, in the case of a TV game, the operation for the progress of data reproduction corresponds to the operation of the game machine and the data are read in response to the operation of the game machine and the listener position is determined according to the progress control information of the game.

More specifically, the sound field reproduction apparatus of this embodiment comprises an operation information for progress input unit 20 that is operated by the operator of the apparatus for the progress of data reproduction, a reproduction progress control unit 21 for controlling the listener position in response to the operation for the progress of data reproduction and determining the listener position information, an optical disc replay unit 202 for replaying the optical disc in response to the operation for the progress of data reproduction, a demultiplexer circuit 302 for demultiplexing the reproduced data, a progress control data decoding circuit 22 for decoding the demultiplexed progress control data, a progress control information storing buffer 23 for storing the decoded progress control information, a sound data decoding circuit 4 for decoding the sound data of each sound channel of the sound packet and the sound source position information, a sound source position information storing buffer 5 for storing the decoded sound source position information, a sound field synthesizing parameter computing means 6 for computationally determining the sound field synthesizing parameters for controlling the channels according to the listener position information and the sound source position information, a sound field synthesizing means 7 for synthesizing a sound field on the basis of the sound field synthesizing parameters and the sound data of the channels, a sound field synthesis control unit 8 for controlling the sound field synthesizing parameter computing means and the sound field synthesizing means on the basis of the listener position information, an amplifier circuit 9 for amplifying the sound signals of the sound channels for which a sound field is synthesized, a speaker system 10 for reverberating a sound field space by using the sound sources of n channels, a text data decoding circuit 11 for decoding the text data separated by the demultiplexer circuit 301, a text reproducing circuit 12 for reproducing the decoded text data, an image data decoding circuit 13 for decoding the image data separated by the demultiplexer circuit 302, a sound field image processing circuit 14 for processing the decoded image data on the basis of the listener position information, an image reproducing circuit 15 for reproducing the image data that have been processed for sound field and image, a superimposing circuit 16 for superimposing the text on the image and an image display unit 17 for displaying the reproduced image.

Figure 11:
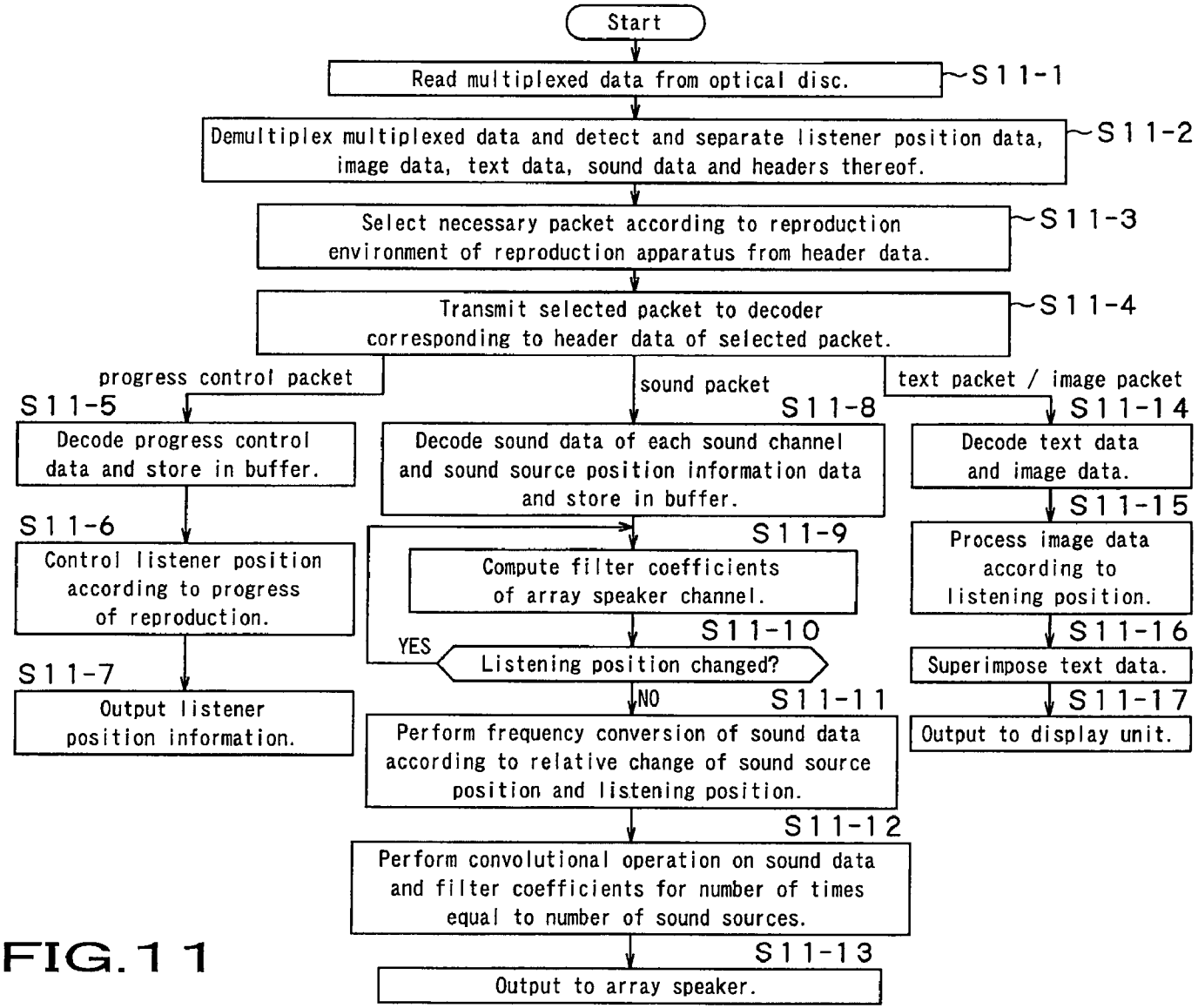
FIG. 11 is a flow chart of the operation of the third embodiment of sound field reproduction apparatus.

Now, the operation of the sound field reproduction apparatus of the third embodiment will be described below by referring to FIG. 11. The optical disc replay unit 202 reads out multiplexed data from the optical disc under the control of the reproduction progress control unit 21 (Step S11-1). Then, the demultiplexer circuit 301 demultiplexes the read out data and detects image data, text data, sound data and headers for them so as to separate them from each other (Step S11-2). Then, it selects the necessary packet depending on the reproduction environment of the optical disc replay unit 2 from the header data (Step S11-3) and transmits the data of the selected packet to the decoder that corresponds to the header of the selected packet (Step S11-4). The reproduction environment is obtained as the reproduction progress control unit 21 controls the optical disc replay unit 202 according to the operation by the operator of the apparatus for the progress of data reproduction and the current data reproducing situation.

The progress control data transmitted to the progress control data decoding circuit 22 in Step S11-4 is decoded and the decoded progress control information is stored in the progress control information storing buffer 23 (Step S11-5). The reproduction progress control unit 21 compares the progress control information stored in the progress control information storing buffer 23 and the operation information for progress input by the operator of the apparatus and controls the listener position according to the progress of data reproduction (Step S11-6). The progress control information includes information on the extent to which the operation for the progress of data reproduction is allowed and hence the operator operates for the progress of data reproduction within that extent. The reproduction progress control unit 21 determines the listener position according to the progress control information. The listener position information on the determined listener position is output to the optical disc replay unit 202, the sound field synthesis control unit 8 and the sound field image processing circuit 14 (Step S11-7).

The sound data and the sound source position information data transmitted to the sound data decoding circuit 4 in Step S11-4 are decoded and stored in the buffer (Step S11-8). The sound source position information that indicates the sound source position of each sound channel, the moving speed and the moving direction of the sound source is stored in the sound source position information storing buffer 5.

The sound field synthesizing parameter computing means 6 computationally determines the coefficients (H1(*f*), . . . , Hn(f)) of the digital filters for controlling the respective channels of the array speaker according to the sound source position information from the sound source position information storing buffer 5 (Step S11-9).

If it is detected in Step S11-10 that the listener position is moving according to the listener position information from the listener position information input unit 1, the sound field synthesis control unit 8 transmits the modifying information to the sound field synthesizing parameter computing means 6 and the sound field synthesizing means 7 so as to have them computationally determine the digital filter coefficients once again from the relative position of the sound source position that varies as a function of the listener position and the sound source position (Step S11-9). If it is not detected that the listener position is changing, the sound field synthesizing means 7 computationally determines the frequency conversion coefficient of the sound data of the sound source from the sound source position information and the listener position information and performs an operation of frequency conversion at the frequency conversion circuit 7*e* (Step S11-11).

The sound field synthesizing means 7 repeats the convolutional operation on the modified filter coefficient as computed in Step S11-9 and the sound data obtained as a result of the frequency conversion in Step S11-11 for a number of times equal to the number of sound sources (Step S11-12). The sound data that are used for the convolutional operation are output to the array speaker (Step S11-13).

The text data and the image data transmitted from the demultiplexer circuit 302 in Step S11-4 are decoded respectively by the text data decoding circuit 11 and the image data decoding circuit 13 according to the coding method and the frame rate contained in the header data (Step S11-14). Then, the decoded image data is processed by the sound field image processing circuit 14 according to the listener position information output from the reproduction progress control unit 21 (Step S11-15). For example, the image data will be processed so as to move the scenic image in response to the movement of the listener. The decoded text signal, on the other hand, is superimposed on the image signal according to the timing information contained in the header data (Step S11-16) and output to the display unit in the image signal format that matches the display unit (Step S11-17).

A filter coefficient bank may be used in place of the sound field synthesizing parameter computing means 6 that computationally determines the digital filter coefficients as shown in FIG. 7.

In this way, with the third embodiment of sound field reproduction apparatus, it is possible to reproduce contents data that changes the listener position information depending on the operation for the progress of data reproduction as in the case of a TV game.

Figure 12:
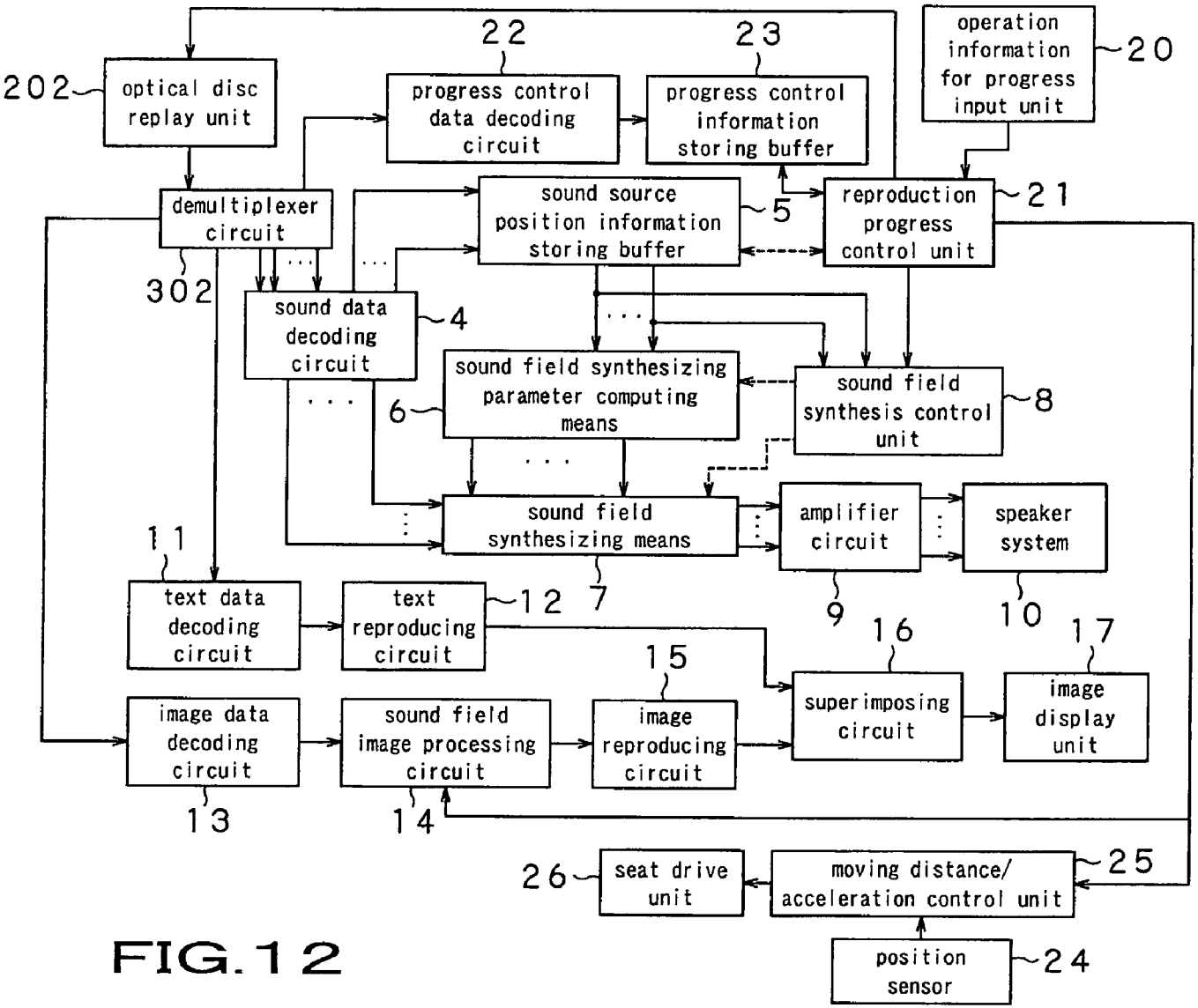
FIG. 12 is a schematic block diagram of the fourth embodiment of sound field space reproduction system according to the invention, illustrating its configuration.

FIG. 12 is a schematic block diagram of the fourth embodiment of sound field space reproduction system according to the invention, illustrating its configuration. This fourth embodiment comprises a seat drive unit for causing the listener to feel a sensation of the acceleration that would be applied to the listener as a result of the movement produced by the operation for the progress of data reproduction according to the listener position information in addition to a sound field reproduction apparatus same as that of the third embodiment.

More specifically, the sound field space reproduction system of the fourth embodiment of the invention comprises a sound field reproduction apparatus same as that of the third embodiment, a position sensor 24 for detecting the seat position of the listener, a moving distance/acceleration control unit 25 for controlling the moving distance and the acceleration of the seat on the basis of the seat position information from the position sensor 24 and the listener position information from the reproduction progress control unit 21 and a seat drive unit 26 for driving the seat as a function of the moving distance and the acceleration of the seat from the moving distance/acceleration control unit 25.

The flow chart of FIG. 11 also applies to the operation of the sound field space reproduction system of the fourth embodiment and therefore only the operation of controlling the seat moving unit will be described below. The reproduction progress control unit 21 outputs listener position information in accordance with the progress control information, which is multiplexed with other information and stored on the optical disc, and the information on the operation for progress. The moving distance/acceleration control unit 25 determines the moving distance and the acceleration of the seat that cause the listener to feel as if he or she is moving on the basis of the listener position information that varies as a function of the progress control information from the reproduction progress control unit 21 and the seat position information from the position sensor 24 and transmits a drive signal to the seat drive unit 26.

In this way, the sound field space reproduction system of the fourth embodiment gives the listener a sensation of moving very naturally.

Figure 13:
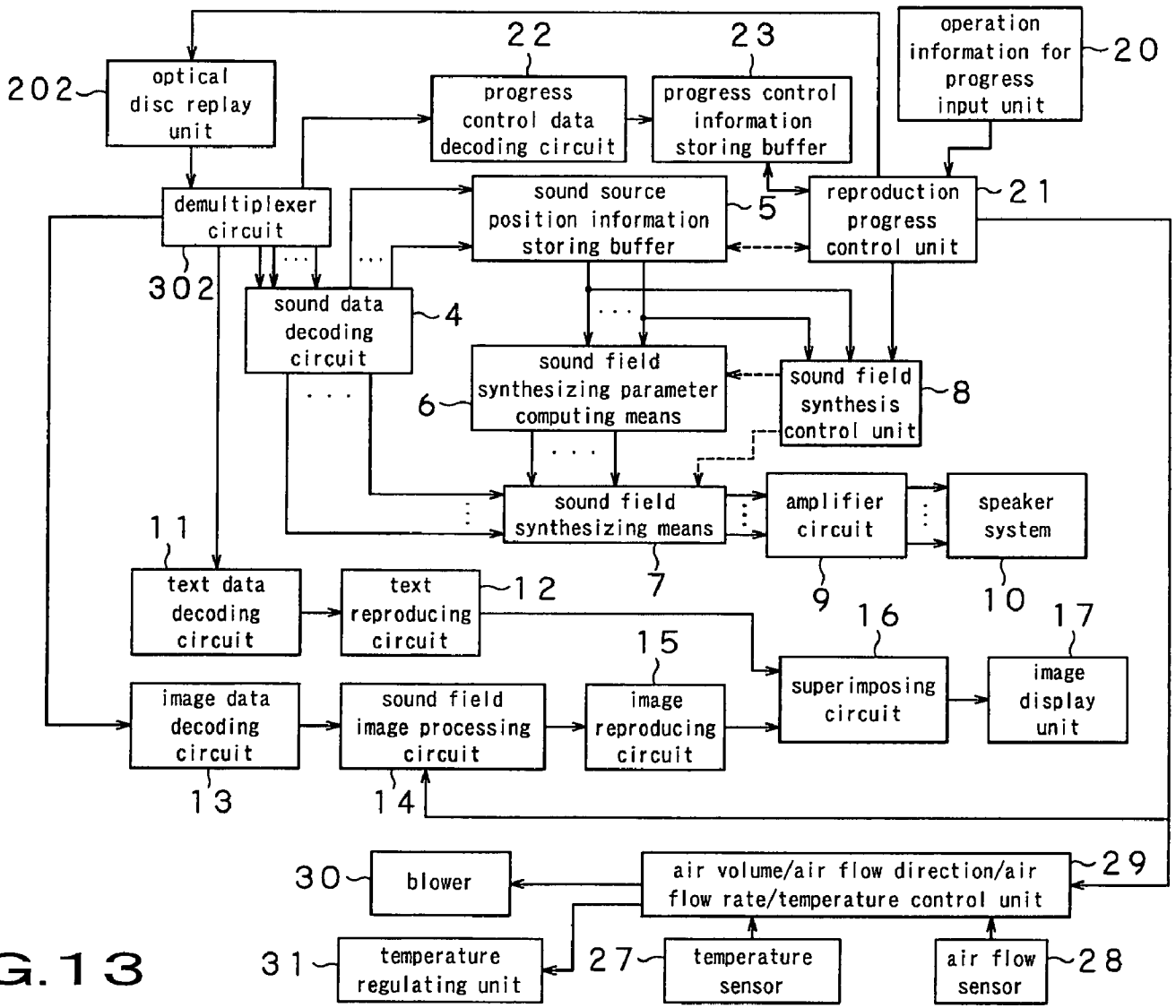
FIG. 13 is a schematic block diagram of the fifth embodiment of sound field space reproduction system according to the invention, illustrating its configuration.

FIG. 13 is a schematic block diagram of the fifth embodiment of sound field space reproduction system according to the invention, illustrating its configuration. This fifth embodiment is adapted to control the air volume, the air flow direction, the air flow rate and the temperature of the air flow (wind) that is applied to the listener according to the listener position that may change due to the movement produced by the operation for progress.

More specifically, the sound field space reproduction system of the fifth embodiment comprises a sound field reproduction apparatus same as that of the third embodiment and a temperature sensor 27 for detecting the temperature of the listening area, an air flow sensor 28 for detecting the air volume, the air flow direction and the air flow rate in the listening area, an air volume/air flow direction/air flow rate/temperature control unit 29 for controlling a blower 30 and a temperature regulating unit 31, which will be described hereinafter, the blower 30 for blowing air to the listening area and the temperature regulating unit 31 for regulating the temperature of the listening area.

The flow chart of FIG. 11 also applies to the operation of the sound field space reproduction system of the fifth embodiment and therefore only the operation of controlling the blower 30 and the temperature regulating unit 31 will be described below. The reproduction progress control unit 21 outputs listener position information in accordance with the progress control information, which is multiplexed with other information and stored on the optical disc, and the information on the operation for progress. The air volume/air flow direction/air flow rate/temperature control unit 29 determines the air volume, the air flow direction, the air flow rate and the temperature necessary for causing the listener to feel as if he or she is moving on the basis of the listener position information according to the progress control information from the reproduction progress control unit 21. The temperature sensor 27 and the air volume sensor 28 constantly detects the air volume, the air flow direction, the air flow rate and the temperature of the listening area and transmits information on them to the air volume/air flow direction/air flow rate/temperature control unit 29.

Thus, with the sound field space reproduction system of the fifth embodiment, wind and temperature act on the tactile sense so that the listener feels naturally as if he or she is moving.

While an operation disc replaying system is used for the above described embodiments, the present invention is by no means limited thereto. For example, the optical disc replay unit may be replaced by a network transmission/reception unit.

With such an arrangement, the information on the image, the text, the sound and the sound source to be reproduced is distributed from the network. The network transmission/reception unit accesses the server that distributes the information on the image, the text, the sound and the sound source and verifies the user terminal. Then, the network transmission/reception unit selects the desired contents from a list of the image/sound contents available to the user and downloads or streams them for reproduction. Otherwise, the apparatus of the system operates same as the above described embodiments.

As described above in detail, a sound field reproduction apparatus and a sound field space reproduction system according to the invention act on the auditory sense, the visual sense and other senses of the listener as a function of the arbitrarily selected listener position in a virtual space and provides a sound field space that gives the listener a sensation of being on site.

What is claimed is:

1. A sound field reproduction apparatus adapted to reproduce a sound field in a virtual space within a predetermined area of a real space from contents data including information on a position of a sound source in a virtual space and sound data in response to information on a position of a listener indicating the position of the listener in the virtual space, the apparatus comprising:

sound field synthesizing parameter generating means for generating sound field synthesizing parameters in response to a relative positional relationship between the position of the listener and the position of the sound source based on information on the position of the listener and information on the position of the sound source;

frequency conversion means for performing frequency conversion on sound data as a function of the relative positional relationship according to the information on the position of the listener and the information on the position of the sound source, in which the frequency conversion on the sound data corresponds to a Doppler effect due to movement of the position of the listener or the position of the sound source;

modifying means for modifying the sound field synthesizing parameters generated by the sound field synthesizing parameter generating means in accordance with a change in the relative positional relationship between the position of the listener and the position of the sound source so as to form modified sound field synthesizing parameters;

sound field synthesizing means for performing a convolutional operation on the sound data subjected to frequency conversion by the frequency conversion means and the modified sound field synthesizing parameters by the modifying means and synthesizing sound data for each of n channels; and sound field reproducing means for performing an operation of wave front synthesis, using the synthesized sound data for each channel and reproducing a sound field in a predetermined area.

2. The apparatus according to claim 1, wherein the sound field synthesizing parameter generating means selects sound field synthesizing based on the relative positional relationship of the listener position and the sound source position from the parameters from the sound field synthesizing parameters stored in advance.

3. The apparatus according to claim 1, wherein the contents data include image data; and the apparatus further comprises image processing means for processing the image data according to the information on the position of the listener.

4. The apparatus according to claim 1, wherein the contents data include the information on the position of the listener.

5. The apparatus according to claim 1, wherein the contents data include progress control data for causing reproduction of the contents data to progress; and the apparatus further comprises:

reproduction progressing means for progressing the reproduction of the contents data based on the progress control data;

progress operating means used by the listener to operate the progress of the contents data; and reproduction progress control means for controlling the progress of the reproduction of the contents data and preparing the information on the position of the listener in response to the operation of the progress operating means.

6. A sound field space reproduction system comprising:

a sound field reproduction apparatus adapted to reproduce a sound field in a virtual space within a predetermined area of a real space from contents data including information on a position of a sound source in a virtual space and sound data in response to information on a position of a listener indicating the position of the listener in the virtual space; and a reverberating apparatus for reverberating the environment in a virtual space in a real space;

the sound field reproduction apparatus having:

sound field synthesizing parameter generating means for generating sound field synthesizing parameters in response to a relative positional relationship between the position of the listener and the position of the sound source based on information on the position of the listener and information on the position of the sound source;

frequency conversion means for performing frequency conversion on sound data as a function of the relative positional relationship according to the information on the information on the position of the listener and the information on the position of the sound source, in which the frequency conversion on the sound data corresponds to a Doppler effect due to movement of the position of the listener or the position of the sound source;

modifying means for modifying the sound field synthesizing parameters generated by the sound field synthesizing parameter generating means in accordance with a change in the relative positional relationship between the position of the listener and the position of the sound source so as to form modified sound field synthesizing parameters;

sound field synthesizing means for performing a convolutional operation on the sound data subjected to frequency conversion and the modified sound field synthesizing parameters and synthesizing sound data for each of n channels; and sound field reproducing means for performing an operation of wave front synthesis, using the synthesized sound data for each channel and reproducing a sound field in a predetermined area.

7. The system according to claim 6, wherein the reverberating apparatus has seat moving means for moving the seat of the listener according to the information on the position of the listener.

8. The system according to claim 6, wherein the reverberating apparatus has air blowing means for blowing air toward the listener according to the information on the position of the listener.

* * * * *

UNITED STATES PATENT AND TRADEMARK OFFICE

CERTIFICATE OF CORRECTION

PATENT NO. : 7,783,047 B2
APPLICATION NO. : 10/987851
DATED : August 24, 2010
INVENTOR(S) : Masayoshi Miura and Susumu Yabe It is certified that error appears in the above-identified patent and that said Letters Patent is hereby corrected as shown below:

On the title page, and on column 1, the title should read --SOUND FIELD REPRODUCTION APPARATUS AND SOUND FIELD SPACE REPRODUCTION SYSTEM--.

Signed and Sealed this
Seventeenth Day of May, 2011

David J. Kappos

David J. Kappos
*Director of the United States Patent and Trademark Office*